US008011299B2

(12) United States Patent
Vosahlo

(10) Patent No.: US 8,011,299 B2
(45) Date of Patent: Sep. 6, 2011

(54) PRINTING WITH INK

(75) Inventor: Jindrich Vosahlo, Royston (GB)

(73) Assignee: Inca Digital Printers Limited (GB)

( * ) Notice: Subject to any disclaimer, the term of this patent is extended or adjusted under 35 U.S.C. 154(b) by 1027 days.

(21) Appl. No.: 10/520,122

(22) PCT Filed: Jul. 1, 2003

(86) PCT No.: PCT/GB03/02834

§ 371 (c)(1),
(2), (4) Date: Jan. 12, 2006

(87) PCT Pub. No.: WO2004/002746

PCT Pub. Date: Jan. 8, 2004

(65) Prior Publication Data

US 2006/0230969 A1 Oct. 19, 2006

(30) Foreign Application Priority Data

Jul. 1, 2002 (GB) ..... 0215168.6
Dec. 20, 2002 (GB) ..... 0229825.5

(51) Int. Cl.
*B41F 35/00* (2006.01)
*B41J 2/01* (2006.01)

(52) U.S. Cl. ..... 101/424.1; 347/102

(58) Field of Classification Search ..... 101/424.1; 347/101, 102, 106

See application file for complete search history.

(56) References Cited

U.S. PATENT DOCUMENTS 4,072,099 A * 2/1978 Martin ..... 101/44
4,180,615 A * 12/1979 Bettoli ..... 428/339
4,309,452 A 1/1982 Sachs
4,313,969 A * 2/1982 Matthews et al. ..... 427/494
4,411,931 A * 10/1983 Duong ..... 427/492
4,485,123 A * 11/1984 Troue ..... 427/492
4,748,453 A * 5/1988 Lin et al. ..... 347/41
4,836,102 A * 6/1989 Cicci ..... 101/41
4,910,116 A * 3/1990 Nakai et al. ..... 430/138
5,394,059 A * 2/1995 Ohyama et al. ..... 313/639
5,407,708 A * 4/1995 Lovin et al. ..... 427/493
5,500,040 A * 3/1996 Fujinami ..... 522/53

(Continued)

FOREIGN PATENT DOCUMENTS

EP 0 842 051 B1 2/2000

(Continued)

OTHER PUBLICATIONS

UV LED Cure All from www.uvps.com/products/led cure-all, asp, printed Mar. 17, 2003, pp. 1-2.

(Continued)

*Primary Examiner* — Daniel J Colilla
*Assistant Examiner* — David Banh
(74) *Attorney, Agent, or Firm* — Harness, Dickey & Pierce, P.L.C.

(57) ABSTRACT

A method is disclosed of printing an area of a substrate in a plurality of passes using curable ink, the method comprising depositing a first pass of ink on the area, partially curing ink deposited in the first pass, depositing a second pass of ink on the area, and fully curing the ink on the area. The method finds particular application in the field of inkjet printing, and can afford the advantage of better wetting of ink on the substrate deposited by a previous pass and reducing the problem of ink spreading.

23 Claims, 4 Drawing Sheets

U.S. PATENT DOCUMENTS

| | | | | |
|---|---|---|---|---|
| 5,535,673 | A | 7/1996 | Bocko et al. | |
| 5,870,112 | A * | 2/1999 | Kang et al. | 347/9 |
| 5,883,648 | A * | 3/1999 | Hetzer | 347/33 |
| 6,017,660 | A | 1/2000 | Ubell et al. | |
| 6,092,890 | A * | 7/2000 | Wen et al. | 347/101 |
| 6,129,464 | A * | 10/2000 | Nakamura et al. | 400/279 |
| 6,145,979 | A | 11/2000 | Caiger et al. | |
| 6,312,123 | B1 * | 11/2001 | Codos et al. | 347/102 |
| 6,331,056 | B1 | 12/2001 | Nohr et al. | |
| 6,354,700 | B1 * | 3/2002 | Roth | 347/103 |
| 6,443,569 | B1 | 9/2002 | Mheidle et al. | |
| 6,447,112 | B1 * | 9/2002 | Hu et al. | 347/102 |
| 6,454,405 | B1 * | 9/2002 | Stowe | 347/102 |
| 6,457,823 | B1 * | 10/2002 | Cleary et al. | 347/102 |
| 6,561,640 | B1 * | 5/2003 | Young | 347/102 |
| 6,699,352 | B2 * | 3/2004 | Sawatsky | 156/277 |
| 6,739,716 | B2 | 5/2004 | Richards | |
| 6,991,830 | B1 * | 1/2006 | Hansson et al. | 427/504 |
| 7,104,642 | B2 | 9/2006 | Takabayashi | |
| 7,152,969 | B2 * | 12/2006 | Hintermann | 347/102 |
| 7,276,265 | B2 * | 10/2007 | Sigel et al. | 427/494 |
| 7,498,065 | B2 | 3/2009 | Siegel | |
| 2001/0046652 | A1 | 11/2001 | Ostler et al. | |
| 2002/0009553 | A1 * | 1/2002 | Lutz | 427/552 |
| 2002/0024544 | A1 * | 2/2002 | Codos | 347/8 |
| 2002/0044188 | A1 | 4/2002 | Codos | |
| 2002/0064616 | A1 * | 5/2002 | Sawatsky | 428/35.7 |
| 2002/0070997 | A1 * | 6/2002 | Nakagawa et al. | 347/37 |
| 2002/0099111 | A1 | 7/2002 | Macdonald et al. | |
| 2002/0149660 | A1 | 10/2002 | Cleary et al. | |
| 2003/0035037 | A1 | 2/2003 | Mills et al. | |
| 2003/0054116 | A1 * | 3/2003 | Dawson et al. | 427/487 |
| 2003/0129369 | A1 * | 7/2003 | MacQueen et al. | 428/204 |
| 2003/0227527 | A1 | 12/2003 | Richards | |
| 2004/0011457 | A1 | 1/2004 | Kobayashi et al. | |
| 2004/0090794 | A1 | 5/2004 | Ollett et al. | |
| 2004/0189769 | A1 * | 9/2004 | Wilbur et al. | 347/102 |
| 2004/0189770 | A1 | 9/2004 | Hintermann | |
| 2004/0189771 | A1 | 9/2004 | Hasebe et al. | |
| 2006/0007290 | A1 | 1/2006 | Oshima et al. | |
| 2006/0050122 | A1 * | 3/2006 | Nakano et al. | 347/102 |
| 2007/0115335 | A1 * | 5/2007 | Vosahlo et al. | 347/102 |

FOREIGN PATENT DOCUMENTS

| | | | |
|---|---|---|---|
| EP | 1 108 553 | A1 | 6/2001 |
| EP | 1 108 723 | | 6/2001 |
| EP | 1 428 670 | | 6/2004 |
| EP | 1 428 670 | A1 | 6/2004 |
| GB | 2338212 | A * | 12/1999 |
| GB | 2 350 321 | | 11/2000 |
| GB | 2 399 162 | | 9/2004 |
| JP | 02-311569 | | 12/1990 |
| JP | 04-214383 | | 5/1992 |
| JP | 2001-038888 | | 2/2001 |
| JP | 2003-285423 | | 10/2003 |
| JP | 2003285423 | A * | 10/2003 |
| WO | WO 97/04964 | | 2/1997 |
| WO | 99/19074 | | 4/1999 |
| WO | WO 99/19074 | | 4/1999 |
| WO | 99/29787 | | 6/1999 |
| WO | WO 02/053384 | A1 | 7/2002 |
| WO | WO 03/057488 | | 12/2002 |
| WO | 03/044106 | | 5/2003 |
| WO | 03/057488 | | 7/2003 |
| WO | WO 03/103970 | A2 | 12/2003 |
| WO | WO 2004/078477 | | 9/2004 |

OTHER PUBLICATIONS

HNG Series Membrane Nitrogen Generators from www.hankisonintl.com/new/htm, printed Oct. 8, 2002, multiple pages.

Hankinson International News Release from www.hankisonintl.com/new.htm, printed Oct. 8, 2002.

"An Introduction to UV Curing and the UV inerted curing process" by R.C. Denney, Fusion UV Systems Ltd from www.coatings.de/ren/reading/denney.htm printed Sep. 13, 2002.

UV Ink from www.dotrix.be/products technologies/technologies uv inks. asp, printed Sep. 13, 2002.

UV Lamp using 370nm UV LED for UV Rays Applications from www.marubenisunnyvale.com/uv lamp.html, printed Sep. 13, 2002.

Primarc UV Lamps from www.primarcuv.com/primarcuv/electroderfg.htm, printed Sep. 13, 2002.

2000 and beyond: LEDs Reach Across Temporal and Spectral Boundaries from http://ledmuseum.home.att.net/2000.htm, printed 13 Sep. 2002.

UV Curing Technical Information Page from www.uvcuring.com/uvguide/chap3 1/chapter 3 1.htm, printed Sep. 13, 2002.

* cited by examiner

PRINTING WITH INK

The invention relates to printing with ink. The invention finds particular, but not exclusive, application in printing with curable ink, in particular with UV curable ink. Particularly preferred examples of the invention relate to the ink-jet printing of curable inks, in particular UV curable ink.

The use of curable inks in printing is well known. Curable ink is preferably to be understood to include ink which solidifies by reaction, in particular for example polymerisation and/or crosslinking. Of particular interest is UV curing ink.

For many curable inks, the ink is solidified by exposing the ink to radiation. In the use of UV curable inks, the ink is deposited on a substrate using a suitable method, and then the ink may be cured by exposing the ink on the substrate to UV light. The exposure of the ink to UV light initiates a chemical reaction which turns the liquid ink into a solid. In other examples, curing is effected using other curing radiation, for example gamma radiation. UV curable inks may be cured using an electron beam, for example from an electron gun. Some inks can be cured simply by applying heat, for example employing an IR source. However, the heat input required to achieve a temperature for rapid cure is often too high for this to be an attractive method.

There are well known UV curing inks that are used in flexographic printers. A flexographic printer is in effect a sophisticated version of a John Bull printing set. The image is typically formed in relief on a rubbery mat, which is pulled around a cylinder. As this cylinder revolves, the ink is applied onto the raised part of the surface via another roller, and the inked surface then is pressed onto the substrate as it goes through the "nip". The inked substrate then passes under a UV lamp, which cures the ink.

Flexographic UV curing inks are relatively viscous and the flexographic process generally produces a much thinner layer of ink on the substrate compared with a piezo inkjet printer, for example.

In an inkjet printing process, the printed image is built up on a substrate by printing drops of ink onto the substrate. The drops of ink are formed by droplets of ink emitted from the nozzles of an inkjet printhead.

The printhead is moved relative to the substrate and the printed image is typically built up in successive passes of one or more printheads across the substrate.

The inkjet process tends to produce structures within the ink film printed on the substrate which are undesirable compared with the flat film produced by, for example, flexographic printing.

In inkjet printing, the ink is delivered onto the substrate as closely spaced rows of droplets, and, as a result, there is a tendency for the ink to form ridges, which are then solidified when exposed to the curing radiation, for example UV light. This effect is especially pronounced when printing onto a low surface-energy substrate such as polypropylene. The ink drops on the substrate tend to pull up from the surface and form balls of ink, which produce balls or ridges on the ink surface. Such structures can reflect light from their surfaces. These balls or ridges produce undesirable glints in the final printed surface, which can look similar to the glints from the surface of a vinyl record disk.

In addition, it is often the case that the cured ink has a much lower surface energy than the liquid ink. In scanning applications, where the inkjet printhead makes several passes over an area of a substrate in order to cover it with ink, it can often be seen that the droplets of liquid ink from later passes do not flow over the cured ink from previous passes. As well as accentuating the ridged structure of the film, this can create two further undesirable effects on the micro-scale:

- Wide, shallow droplets of cured ink on the surface can lie next to deep ball-shaped droplets that have not been able to spread out because they do not wet the wide shallow droplets. The colour effect is thus impaired because the colour saturation of the wide, shallow droplets is insufficient, and that of the adjacent deep droplets is excessive. The resulting perceived colour is not an "average" because an over-saturated area, for example at the deep drops, results in a different hue. The effect is to restrict the colour gamut achievable, and to reduce the brilliance of the colours.
- Heavy areas of printing will have many droplets landing on top of previous drops. The later arrivals can form balls of ink on the cured surface of earlier drops, either individually or joined up in ridges. This not only accentuates the problem described above, but it also can produce heavy glinting from the surface structure.

Furthermore, the rough surface which can be produced when the drops form balls or ridges on the substrate gives a matt or satin finish to the printed image. This can be undesirable in situations where a gloss finish would be preferred.

Aspects of the present invention seek to mitigate one or more of the problems identified above.

Accordingly, in a first aspect of the invention, there is provided a method, for use with an inkjet device (such as an inkjet printer), of printing an area of a substrate in a plurality of passes using curable ink, the method comprising depositing a first pass of ink on the area; partially curing ink deposited in the first pass; depositing a second pass of ink on the area; and fully curing the ink on the area.

In order to reduce the effect of the problems above, we arrange that new ink arriving on the surface can wet the ink that has previously been deposited. An alternative way it might be considered to do this is simply not to cure the ink until it has all been laid down, but that arrangement has the problem that a layer of uncured ink, of low viscosity, tends to spread; that is, the ink drops tend to flow together, producing a smeared effect. Also, ink droplets on the surface can form an uneven structure of pools and islands of unwetted substrate, thereby reducing detail in the printed image.

It is possible, in a multi-pass print, to leave one pass uncured if the density of ink is low enough, but in practice this will have little beneficial effect and may in fact exacerbate some of the problems if later drops fall on a thin layer of low surface energy cured ink.

Preferably, the substrate is flat and preferably it is relatively thin in comparison to its cross-sectional area. Preferably, the substrate can be mounted onto a substrate table. Preferably, the substrate comprises paper or card or polypropylene film or other types of film. Preferably the substrate includes the final printed image. Additionally, preferably each of the plurality of passes is partially cured. Preferably, the method further includes effecting the full curing step after at least two passes. Preferably full curing is effected after the final pass. Preferably more than one pass is made by one or more printheads over the same region of substrate.

Thus, according to the first aspect of the invention, it has been found that, by partially setting or curing the ink before the next pass is deposited, better wetting of the ink on the substrate from a previous pass by the subsequent pass can be achieved, while reducing the problem of ink spreading. The partial cure may have the effect of raising the viscosity of the ink. This can have the effect of immobilising the ink on the surface, while leaving the exposed surface of the ink wettable by ink deposited in the second pass.

Preferably, the partial curing step is such that an exposed surface of the partially cured ink is in non-solidified form, and more preferably an exposed surface of the partially cured ink is in a substantially liquid or gel form. By arranging for the partial curing step to leave the exposed (usually the top) surface of the ink in such a non-solidified (such as substantially liquid or gel) form, better wetting by the subsequent ink deposited can be achieved.

The exposed surface of the ink might remain liquid or gelled by hindering curing at the surface. Preferably the exposed surface of the partially cured ink is prevented from solidifying by oxygen inhibition, for example by ensuring that the ink has oxygen inhibition properties such that the oxygen in the air slows the curing reaction at the exposed surface of the ink. Additionally, the oxygen inhibition may be enhanced, for example by blowing oxygen (or air) on the exposed surface. Preferably the partially cured ink is easily wetted by fresh ink applied to its surface.

Preferably the partial setting step effects at least partial curing of the ink adjacent the substrate. In this way spreading of the ink can be reduced. A region of the ink adjacent the substrate may be completely cured. It will be understood that the ink from a particular pass may be directly adjacent the substrate, or there may be one or more previously deposited droplets between the new droplet and the substrate. It should be understood that, where appropriate, reference to ink adjacent the substrate preferably includes ink adjacent a previously printed droplet of ink.

Preferably the partial curing step effects at least partial curing of the ink such that the partially cured ink is stable after a period of minutes. The time taken for the ink to become stable may of course depend on the type of ink, physical dimensions of the inkjet device, and so on. Preferably ink is considered to be 'stable' when the image quality is not affected by small changes in the period between laydown and full cure. The ink may be stable after 1, 2, 3, 5 or 10 minutes.

Preferably the partial curing step produces a fixed level of gloss of the ink on the area, although alternatively the partial curing step may control the level of gloss of the ink on the area.

Preferably the step of partially curing the ink is effected by a first device, and the step of fully curing the ink is effected by a second device, wherein the location of the first device is not proximate to the location of the second device. Alternatively, the step of partially curing the ink is effected by a first device and the step of fully curing the ink is effected by a second device and the location of the first device may be separate from the location of the second device. Preferably the partial curing step includes a further step of varying the level of partial cure depending on the rate of printing, so as to maintain a fixed level of gloss.

Preferably the ink comprises radiation curable ink, preferably UV curable ink. The UV curable ink may be cured using other types of radiation, for example electron beam radiation or gamma radiation.

Preferably the method comprises partially curing the first passes of ink, a hard curing only being carried out when all the ink has been deposited. Partial curing is most effective when the ink is not exposed to the shorter wavelengths of radiation needed to achieve full cure of the ink surface. The objective in preferred examples of the invention is to solidify, or at least to gel, or to at least increase the viscosity of the layer of ink adjacent the substrate, but to leave the surface liquid or as a gel. This is thought to be possible due to the mechanism of oxygen inhibition. Dissolved oxygen acts to inhibit the curing of the ink, and the action of the initiator is to mop up all the free oxygen and thus to allow the polymerisation to proceed. Near a free surface in air, the oxygen can be replenished quickly by diffusion, so a low dose of radiation can have the desired effect of at least partially curing the bottom of the film but not the top surface.

The partial cure is preferably tuned to leave the surface of the ink in a liquid or gel state, while setting the lower layers. For example, for an ink which cures by free radical curing, this can be done by using selected wavelengths and intensity of light according to the type of initiator, for example UV initiator, used in the ink.

Additionally, the dose of curing radiation applied to a region of ink in the partial curing step may be varied so as to vary the level of gloss of the printed ink on the area.

The total curing dose delivered (J/sqm) is proportional to the value of the intensity of the curing radiation (W/sqm) integrated over the region exposed to the radiation, divided by the product of relative speed of the substrate movement and the width of the region irradiated.

Alternatively, the total dose delivered (J/sqm) is proportional to the value of the intensity of the curing radiation (W/sqm) divided by the relative speed of the substrate movement and multiplied by the number of passes made over a given area of substrate.

Preferably the wavelength of the radiation used in the partial curing step is greater than about 370 nm, preferably approximately between 380 nm and 420 nm, and more preferably approximately between 385 nm and 400 nm. The phrase 'wavelength' preferably connotes a nominal wavelength, for example as might be used by manufacturers to identify a type of curing lamp, or by reference to the most dominant wavelength in a group of wavelengths emitted by a given radiation source, for example.

Typically longer wavelengths are used than in single full cures, but this is dependent on the types of initiator used. The wavelength of the radiation used in the partial curing step may even be greater than about 420 nm, for example using different colours of the visible and infrared spectrum. The desirable wavelength will depend on the type of ink used, in particular the curing initiators used in the ink. However, the use of relatively long wavelengths will tend to cure the part of the drop adjacent the surface more than the exposed surface, which is desirable in that it can aid immobilisation of the drop on the substrate. The long wavelength radiation is thought to be more penetrating into ink drops close to the substrate and thus effect cure deep in the droplets.

Preferably the fully curing step comprises providing an inerting or low oxygen environment, for example a nitrogen inerting environment. There are several options for achieving this. Using a local nitrogen atmosphere, for example, can reduce the inhibition of the free radical reaction by the presence of oxygen, which diffuses into the ink surface. Mercury arc lamps overcome the effect of oxygen inhibition by emitting enough power such that the rate of free radical production exceeds the rate at which oxygen diffusion can inhibit the reaction. Whereas the need to use a nitrogen atmosphere adds complexity to the system, this is more than compensated by the other advantages described above.

Preferably the term "inerting" is to be understood to refer to an arrangement in which the inerting gas or environment has the effect of reducing inhibition of cure of the ink. The inerting gas or environment may be itself inert, but in many cases it will be sufficiently inerting without itself being completely inert. Thus a low-oxygen gas may provide an inerting environment.

Carbon dioxide gas may be used and/or nitrogen gas may be used.

The radiation used in the fully curing step preferably includes radiation having a wavelength less than the wavelength used in the partial curing step. By contrast to the relatively long wavelength radiation preferably used in the partial cure step, this shorter wavelength radiation can overwhelm the oxygen inhibition effect at the surface and effect solidification of the ink at the surface.

Preferably the method includes the step of supplying gas at a positive pressure in the region of the radiation source. By applying a positive pressure, ingress of, for example, air into the region adjacent to the radiation source can be reduced.

Preferably the radiation used in the full curing step includes radiation having a wavelength less than about 360 nm, preferably approximately between 300 nm and 350 nm, and more preferably approximately between 320 nm and 340 nm. More preferably, the radiation used in the full curing step includes radiation having a wavelength greater than about 370 nm, preferably approximately between 380 nm and 420 nm, and more preferably approximately between 385 nm and 400 nm, for example by employing the same radiation source used in the partial curing step, preferably in addition to a further radiation source of shorter wavelength. The use of both short and long wavelengths afforded by this combination can effect the full cure within the ink as well as substantially at the surface of the ink.

Different methods could be used to effect the partial cure of the ink.

Preferably the method further includes the step of partially curing ink deposited in the second pass.

Preferably the method further includes the step of depositing at least one further pass of ink and partially curing the deposited ink. Preferably a partial cure is carried out after each and every pass.

Preferably an exposed surface of the ink is not solidified in the partial curing step.

This feature is particularly important and is provided independently. A further aspect of the invention provides a method, for use with an inkjet device (such as an inkjet printer), of printing on an area of a substrate using solidifiable ink, the method comprising depositing a first pass of ink on the area; partially solidifying the ink such that an exposed surface of the ink is not solidified in the partial solidifying step.

In another aspect of the invention, there is provided a method, for use with an inkjet device (such as an inkjet printer), of printing an area of a substrate in a plurality of passes using ink, comprising the step of depositing a first pass of ink on the area, wherein the method includes the step of reducing the viscosity of the ink prior to deposition on the substrate.

The reduced viscosity of the ink is easier to print onto the surface, in particular where inkjet printing is used, while the increase in viscosity on the substrate gives the improvements indicated above. The method may include the step of heating the ink prior to its deposition on the substrate.

The method may include the step of heating the ink before depositing the ink on the substrate. Alternatively, the substrate could be cooled to increase the temperature difference between the ink and the substrate.

Thus, generally the ink can be printed at high temperature onto a relatively low temperature substrate. The ink cools immediately upon touching the substrate and becomes much more viscous. This would reduce the amount of flow even without a specific partial cure. This method is thought to be particularly effective for inks which change viscosity sharply with temperature.

Preferably the partially cured or partially solidified ink is such that at least a part of the ink can be displaced by rubbing.

Preferably the partially cured/solidified ink can be smeared or smudged on the surface for example by rubbing a finger or cloth across the printed surface. The ability to smudge or smear the ink is an indication that at least a part of the ink is not fully solidified or cured. This can lead to the improved deposition of further ink onto such a surface.

Thus, in preferred examples, lightly wiping the surface of the partially cured/solidified ink can smear the ink surface. This implies a liquid or gel state of at least a part of the ink.

Sometimes it is seen that the surface of the ink layer can be smeared but will leave a residual layer of ink apparently attached to the surface. It has been observed in some cases that the residual layer is not a hard solid layer.

This feature is of particular importance and is provided independently. Thus a further aspect of the invention provides a method, for use with an inkjet device (such as an inkjet printer), of printing on an area of a substrate using ink, the method comprising depositing a first pass of ink on the area; and partially solidifying/curing the ink, such that the partially cured or partially solidified ink is such that at least a part of the ink can be displaced by rubbing.

Preferably the method further comprises the step of depositing a second pass of ink on the area. The second pass is preferably deposited on or adjacent to the partially set ink of the first pass. Preferably, a partial setting, cure or immobilisation of the ink is carried out after each pass, until all of the ink has been deposited for that area.

Preferably the first pass of ink is such that it is substantially wetted by ink of the second pass.

This feature is of particular importance and is provided independently. Thus a further aspect of the invention provides a method, for use with an inkjet device (such as an inkjet printer), of printing an area of a substrate in a plurality of passes using ink, the method comprising depositing a first pass of ink on the area; and substantially immobilising the ink on the area, wherein the immobilised ink is such that it is substantially wettable by ink of a subsequent pass. The immobilisation may be effected, for example, by partially solidifying or curing the ink.

The wetting may be effected because the surface of the ink droplet is liquid or in gel form compared with the fully cured or solidified ink. Preferably the immobilised ink is readily wettable by the ink deposited in a subsequent printing pass.

The improved wetting of the immobilised ink may be a result of the increased surface energy or surface tension of the immobilised ink compared with the fully cured or solidified ink.

Preferably the partial cure or partial solidification step is such that, when further ink is applied on the partially cured or solidified ink, the further ink forms a substantially flat layer, a substantially glossy layer, and/or a brightly coloured layer compared with the case in which the partial solidification or partial curing is not carried out, for example compared with the case in which a full cure or solidification is carried out before the further ink is deposited. By looking at the quality of the further ink layer, therefore, it can be possible to determine whether a partial cure and/or partial solidification of the initial ink layer has been effected. For example, if full cure or solidification had taken place before the further ink was deposited, in many cases, there will be significant surface structure seen where the further ink droplets have formed balls on the surface of the original ink layer. By using the partial cure or partial solidification step, a marked reduction in, or absence of, such surface structure may be achievable.

Furthermore, where the partial cure or partial solidification has been carried out before the deposition of the further ink, the migration of ink will be reduced compared with the case where no cure or solidification is carried out before deposition of the further ink.

The amount of initiator in the ink can also be optimised to give the desired rate of curing. Preferably the ink of the subsequent pass has substantially the same composition as that of the first pass.

Preferably the method includes the step of fully curing or solidifying the ink on the area.

In another aspect of the invention, there is provided a method, for use with an inkjet device (such as an inkjet printer), of printing an area of a substrate in a plurality of passes using curable ink, the method comprising depositing ink on the area; and at least partially curing the deposited ink.

Preferably the ink is deposited using an inkjet device (such as an inkjet printer).

The method may further comprise emitting the ink using a printer carriage having one or more printheads; at least partially curing the emitted ink using a first radiation source; and substantially fully curing the ink using a second radiation source, wherein the first radiation source for partially curing the ink is arranged to move with the one or more printheads, and the second radiation source for substantially fully curing the ink is arranged such that the one or more printheads can move relative to such radiation source.

Preferably a pass of the one or more printheads across a region of the substrate results in the deposition of a coat of ink. Preferably a successive pass of one or more printheads across the same region of the substrate results in the deposition of a second coat of ink which can partially cover the preceding coat of ink deposited in a preceding pass. Preferably the partial curing step is performed such that a successive coat of ink is deposited smoothly onto a partially cured preceding coat of ink.

Preferably, the partial curing step is performed such that the difference in surface finish between successive passes is less noticeable to the eye.

Furthermore, preferably each printing pass prints a partial image on the substrate. Preferably the total effect of all passes results in a single image on the substrate, and preferably ink deposited during each pass is individually cured by a curing step.

The method may also further comprise providing a beam movable with respect to the area of the substrate; and providing a printer carriage adapted to move along the beam as well as with the beam, wherein the radiation source for fully curing the ink is adapted to move only with the beam.

Alternatively, the method may further comprise providing a beam movable with respect to the area of the substrate; and providing a printer carriage adapted to move along the beam as well as with the beam, wherein the radiation source for fully curing the ink and the beam are adapted to be relatively moveable.

Curing of UV curable ink can be effected utilising a number of different possible radiation sources, such as light emitting diodes (LEDs) which can provide cheap and efficient conversion of electrical power to curing radiation. Since LEDs are relatively light and compact, they can conveniently be mounted on the carriage/printhead thereby reducing its inertia by comparison with say Mercury Vapour Lamps.

Accordingly, the method preferably further comprises emitting radiation from a light emitting diode (LED) towards the ink.

Light emitting diodes (LEDs) are well known. Such sources of radiation are cheap, light weight, highly efficient in their conversion of electrical power, and can give effectively instant switching to full power.

Another advantage is that the emission spectrum of an LED is usually a sharp peak. Typically over 90% of the emission is within about ±15 nm of the peak.

LED devices therefore overcome many of the disadvantages of existing curing devices listed above. The LED may be used to effect a full cure of the ink, or may be used with another method, for example another radiation source, to cure the ink, and/or may effect partial cure of the ink.

The LED may be chosen to emit radiation of any wavelength desirable to effect cure of the ink. It will be understood that the radiation emitted will not necessarily be in the visible spectrum.

Preferably the LED emits UV radiation. Thus the LED can be used to effect cure of UV-curable ink. Preferably the LED emits radiation having a wavelength between 200 and 400 nm, preferably less than 400 nm.

It will be understood that the LED source will usually emit radiation having a spread of wavelengths. The width of this band of wavelengths will be significantly less for a LED source than, for example, a mercury source and for preferred LED sources, at least 90%, preferably at least 95%, of the emitted radiation has a wavelength within a band of about 50 nm or less.

Preferably the wavelength of the LED is chosen substantially to match the absorption profile of the ink, for example a photoinitiator in the ink, or vice-versa. Preferably, the wavelength of the emitted radiation is in the range of 280 to 450 nm, which is normally present only at low intensities in ambient lighting. In this way, stray radiation is less likely to cure the ink before the desired curing time, for example the ink in the printheads themselves is less likely to cure when exposed to ambient lighting. The LED to be used could be chosen on the basis of the properties of the ink to be used, or the ink could be formulated to respond to the emission of the LED, or a combination of the two.

LED sources are available which emit at the blue end of visible spectrum (around 405 nm) and in the near UV (at 370 nm and also 385 nm). The trend is to LEDs emitting at shorter wavelengths becoming available. Thus UV-LEDs can be used in arrangements suitable for use with a mercury lamp.

By using an array of radiation sources, for example LEDs, the intensity of radiation emitted towards an area of ink can be made more even compared with a case where a few, or one, LED is used. A single LED would give an intense spot of radiation in an area; by using an array of LEDs, the intensity of radiation received by areas of ink can be made more even, thus giving better results from the curing.

Preferably, the radiation is emitted from an elongate source. The source preferably includes an array of LEDs. Preferably the width of the source is selected on the basis of the relevant dimensions of the nozzle row. Preferably the width of the array is such that as a "stripe" of ink is emitted in a pass of a printhead, the source emits radiation towards substantially the whole width of the stripe. In preferred examples, the width of the source at least approximately corresponds to the width of the nozzle array of the printheads used.

Preferably, the length of the array in the direction parallel to the cure direction will be chosen with regard to, for example, the speed of relative movement of the substrate and the source and the intensity of radiation required to effect cure.

Preferably, the source comprises an array of LEDs and is moved relative to the ink to be cured in the cure direction, wherein the LEDs do not form a column substantially aligned with the cure direction. If the LEDs were so aligned, then there might be regular patterns in intensity of the radiation formed across the width of an area of ink perpendicular to the cure direction. This might, in turn, lead to visible variations in the cured ink across the area. By staggering the LEDs of the array, such a situation may be avoided.

Preferably, a preferred array of LEDs includes a plurality of rows substantially aligned in a direction substantially perpendicular to the cure direction, the rows being offset so that the LEDs are not aligned parallel to the cure direction.

Preferably the LEDs of the array are offset in a direction substantially perpendicular to the cure direction so that no columns of LEDs are present which would produce artefacts, for example at the pitch of the LEDs.

Preferably the edge of the array is such that the intensity of radiation across a print swathe is substantially constant. Preferably the edge of the array is angled with respect to the cure direction. Preferred arrays are generally in the shape of a parallelogram or trapezium, although other shapes might be used.

Preferably, as mentioned above, the method includes providing a reduced oxygen environment in the region of the LED. This feature is particularly preferred where the mechanism by which the ink cures includes free radical formation.

However, the radiation emitted by the LED or array of LEDs may not, in some cases, have sufficient energy to react with the reactive groups in the ink (for example photoinitiator molecules) to generate enough free radicals to effect full cure at atmospheric conditions. By providing a reduced oxygen environment, the desired cure can be effected, in particular for free radical curing inks. Preferably a blanket of reduced oxygen gas is provided over an area of the ink to be cured.

Preferably the percentage by volume of oxygen in the region of the ink adjacent the LED is less than 5%, preferably less than 2%, more preferably less than 1%. The acceptable level of oxygen in the gas at the ink surface will depend on the intensity of the radiation, the chemistry of the ink used (for example the amount and type of photoinitiator included in the ink), the thickness of the ink film to be cured, the amount of cure required, the degree of entrainment of the atmosphere into the region adjacent the ink to be cured and other factors.

One of the important benefits of using an LED in the curing of ink, is that the radiation emitted by the LED falls within a narrow band of wavelengths compared with other sources. Some LED sources, for example produce radiation having wavelength such that at least 90% is within a band of approximately 30 nm.

Preferably, the ink includes a photoinitiator adapted to respond to radiation emitted by the source, a photosensitiser adapted to respond to radiation emitted by the source and/or a photosensitiser adapted to alter, preferably to extend, the spectral response of the radiation-curable ink.

Preferably the LED emits UV radiation.

Preferably the LED emits radiation from an array of LED's towards the ink

Preferably a low-oxygen atmosphere is provided at the ink to be cured when using radiation emitted from a LED.

Where the partial cure radiation source and/or full cure radiation source is provided by one or more LED's, the use of varying levels of inerting at either or both the partial cure and full cure steps and the use of different radiation sources at either of the partial cure or full cure steps can vary the total dose of curing radiation required and can also vary the distribution of the total curing radiation used at the partial cure step and the full cure step.

Preferably, where the curing radiation is provided by at least one LED but some inerting is used with the full cure step only, the share of the total received dose of curing radiation used at the partial cure step as compared to the share received at the full cure step is between 30% and 100% of the total dose, even more preferably between 40% and 75%, even more preferably between 45% and 55%, most preferably about 50%.

Preferably, where the curing radiation is provided by at least one LED and some inerting is used with the partial cure step and more inerting is used at the full cure step, the share of the total received dose of curing radiation used at the partial cure step as compared to the share received at the full cure step is between 0.1% and 25% of the total dose, more preferably between 1% and 20%, even more preferably between 6% and 15%, most preferably about 10%.

Preferably, where the curing radiation for the partial cure step is provided by at least one LED and the curing radiation for the full cure step is provided by a bulb and some inerting is used with the partial cure step and some (maybe a similar amount of) inerting is used at the full cure step, the share of the total received dose of curing radiation used at the partial cure step as compared to the share received at the full cure step is between 0.1% and 25% of the total dose, more preferably between 1% and 20%, even more preferably between 6% and 15%, most preferably about 10%.

A further aspect of the invention provides a printer adapted to print an area by a method as described herein.

A further aspect of the invention provides an apparatus for use in printing an area of a substrate in a plurality of passes using curable ink, comprising: a printhead arranged to deposit a first pass of ink on the area; means (typically a radiation source) for partially curing the ink deposited in the area; a printhead arranged to deposit a second pass of ink on the area; and means (typically a radiation source) for fully curing the ink on the area. Preferably the apparatus includes a radiation source for partially curing the ink.

The means for partially curing the ink is preferably adapted to partially cure the ink such that an exposed surface of the partially cured ink is in non-solidified form. More preferably, the means for partially curing the ink is adapted to partially cure the ink such that an exposed surface of the partially cured ink is in substantially liquid or gel form. The exposed surface of the partially cured ink is preferably prevented from solidifying by oxygen inhibition. The means for partially curing the ink may further be adapted to at least partially cure the ink adjacent the substrate.

Preferably, the means for partially curing the ink is adapted to cure the printed ink such that it is stable after a period of minutes, such as 1, 2, 3, 5 or 10 minutes.

The means for partially curing the ink is preferably adapted to produce a fixed level of gloss of the ink on the area. Alternatively, the means for partially curing the ink may be adapted to control the level of gloss of the ink on the area.

The means for partially curing the ink may not be proximate to the means for fully curing the ink. Furthermore, the means for partially curing the ink may be separate from the means for fully curing the ink. The means for partially curing the ink may be adapted to vary the level of the partial cure depending on the rate of printing.

Preferably the ink comprises radiation curable ink, and preferably comprises UV curable ink.

The apparatus may comprise means for varying the radiation output of the radiation source so as to vary the level of gloss on the printed ink on the area.

Preferably the means for partially curing the ink is adapted to produce radiation having a wavelength greater than about 370 nm, preferably approximately between 380 nm and 420 nm, and more preferably approximately between 385 nm and 400 nm.

Preferably the means for fully curing the ink is adapted to providing an inerting or low oxygen environment.

Also preferably the means for fully curing the ink is adapted to produce radiation having a wavelength less than that produced by the means for partially curing the ink. The means for fully curing the ink is preferably adapted to produce radiation having a wavelength less than about 360 nm, preferably approximately between 300 nm and 350 nm, and more preferably approximately between 320 nm and 340 nm. The means for fully curing the ink may also be adapted to produce radiation having a wavelength greater than about 370 nm, preferably approximately between 380 nm and 420 nm, and more preferably approximately between 385 nm and 400 nm.

Preferably the apparatus includes means for partially curing ink deposited in the second pass, and may include means for depositing at least one further pass of ink and means for partially curing the deposited ink. The means for partially curing the ink may be adapted to cure the ink such that an exposed surface of the ink is not solidified.

A further aspect of the invention provides apparatus for printing on an area of a substrate using solidifiable ink, the apparatus comprising: a printhead arranged to deposit a first pass of ink on the area; and means for partially solidifying the ink such that an exposed surface of the ink is not solidified in the partial solidifying step.

The apparatus may comprise means for cooling an area of the substrate. The apparatus may comprise means for heating the ink before depositing the ink on the substrate. The apparatus may comprise means for reducing the viscosity of the ink prior to deposition on the substrate.

The means for partially curing the ink may be adapted to partially cure or partially solidify the ink such that at least a part of the ink can be displaced by rubbing.

A further aspect of the invention provides apparatus for printing on an area of a substrate using ink, the apparatus comprising: a printhead for depositing a first pass of ink on the area; and means (typically a radiation source) for partially solidifying/curing the ink such that the partially cured or partially solidified ink is such that at least a part of the ink can be displaced by rubbing.

Preferably the apparatus is further adapted to deposit a second pass of ink on the area.

A further aspect of the invention provides apparatus for printing an area of a substrate in a plurality of passes using ink comprising: a printhead for depositing a first pass of ink on the area; and means (typically a radiation source) for substantially immobilising the ink on the area, wherein the immobilised ink is such that it is substantially wetted by ink of a subsequent pass.

Preferably the apparatus comprises a radiation source for substantially fully curing or solidifying the ink on the area.

A further aspect of the invention provides the use of a heated ink in the printing of a substrate.

In another aspect of the invention there is provided apparatus, for an inkjet device (such as an inkjet printer), for printing an area of a substrate in a plurality of passes using curable ink, the apparatus comprising means for depositing ink on the area, and means for at least partially curing the deposited ink.

Preferably the printer carriage comprising one or more printheads and a radiation source for at least partially curing ink emitted by the one or more printheads.

The carriage may further include a radiation source for substantially fully curing the ink, or alternatively the carriage may omit a radiation source for fully curing the ink.

The apparatus may further comprise a light emitting diode (LED) adapted to emit radiation towards the ink.

A further aspect of the invention provides a printer carriage for a printer, the printer carriage comprising one or more printheads, a radiation source for partially curing ink emitted by the printheads, and a radiation source for substantially fully curing the ink.

Preferably the radiation source is arranged to fully cure the ink on an area of a printed substrate only after substantially all of the ink has been deposited onto that area.

In a yet further aspect of the invention, there is provided an ink jet carriage incorporating apparatus as aforesaid.

In another aspect of the invention, there is provided an inkjet device (such as an inkjet printer) incorporating an ink jet carriage as aforesaid.

In a further aspect of the invention there is provided an inkjet device (such as an inkjet printer), for printing on an area of a substrate using ink, comprising a printer carriage having one or more printheads and a radiation source for at least partially curing ink emitted by one or more printheads; and a radiation source for substantially fully curing the ink, wherein the radiation source for partially curing the ink is arranged to move with the one or more printheads, and the radiation source for substantially fully curing the ink is arranged such that the one or more printheads can move relative to such radiation source.

The inkjet device preferably further comprises a beam movable with respect to the area of the substrate and a printer carriage adapted to move along the beam as well as with the beam, wherein the radiation source for fully curing the ink is adapted to move only with the beam.

Alternatively the inkjet device may comprise a beam movable with respect to the area of the substrate and a printer carriage adapted to move along the beam as well as with the beam, wherein the radiation source for fully curing the ink and the beam are adapted to be relatively moveable.

In a yet further aspect of the invention, there is provided a method of printing an area of a substrate in a plurality of passes using curable ink, the method comprising the steps of: depositing a first pass of ink on the area; partially curing ink deposited in the first pass; depositing a second pass of ink on the area; and fully curing the ink on the area.

This feature is particularly important and is provided independently. A further aspect of the invention provides a method of printing on an area of a substrate using solidifiable ink, the method comprising: depositing a first pass of ink on the area; partially solidifying the ink such that an exposed surface of the ink is not solidified in the partial solidifying step.

Thus a further aspect of the invention provides a method of printing an area of a substrate in a plurality of passes using ink, comprising the step of depositing a first pass of ink on the area, wherein the method includes the step of reducing the viscosity of the ink prior to deposition on the substrate.

This feature is of particular importance and is provided independently. Thus a further aspect of the invention provides a method of printing on an area of a substrate using ink, the method comprising: depositing a first pass of ink on the area; and treating the ink, for example by partially solidifying/curing the ink, such that the treated, for example partially cured or partially solidified, ink is such that at least a part of the ink can be displaced by rubbing.

This feature is of particular importance and is provided independently. Thus a further aspect of the invention provides a method of printing an area of a substrate in a plurality of passes using ink comprising the steps of depositing a first pass of ink on the area; and substantially immobilising the ink on the area, wherein the immobilised ink is such that it is substantially wettable by ink of a subsequent pass. The immobilisation may be effected, for example, by partially solidifying or curing the ink.

A further aspect of the invention provides an apparatus for use in printing an area of a substrate in a plurality of passes using curable ink, comprising: a printhead arranged to deposit a first pass of ink on the area; means (typically a radiation source) for partially curing the ink deposited in the area; a printhead arranged to deposit a second pass of ink on the area; and means (typically a radiation source) for fully curing the ink on the area.

A further aspect of the invention provides apparatus for printing on an area of a substrate using solidifiable ink, the apparatus comprising: a printhead arranged to deposit a first pass of ink on the area; and means for partially solidifying the ink such that an exposed surface of the ink is not solidified in the partial solidifying step.

A further aspect of the invention provides apparatus for printing on an area of a substrate using ink, the apparatus comprising: a printhead for depositing a first pass of ink on the area; and means (typically a radiation source) for partially solidifying/curing the ink such that the partially cured or partially solidified ink is such that at least a part of the ink can be displaced by rubbing.

A further aspect of the invention provides apparatus for printing an area of a substrate in a plurality of passes using ink comprising: a printhead for depositing a first pass of ink on the area; and means (typically a radiation source) for substantially immobilising the ink on the area, wherein the immobilised ink is such that it is substantially wetted by ink of a subsequent pass.

A further aspect of the invention provides a printer carriage for a printer, the printer carriage comprising one or more printheads, a radiation source for partially curing ink emitted by the printheads, and a radiation source for substantially fully curing the ink.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein.

The invention also provides a signal embodying a computer program for carrying out any of the methods described herein and/or for embodying any of the apparatus features described herein, a method of transmitting such a signal, and a computer product having an operating system which supports a computer program for carrying out any of the methods described herein and/or for embodying any of the apparatus features described herein.

The invention extends to methods and/or apparatus substantially as herein described with reference to the accompanying drawings.

Any feature in one aspect of the invention may be applied to other aspects of the invention, in any appropriate combination. In particular, method aspects may be applied to apparatus aspects, and vice versa.

Preferred features of the present invention will now be described, purely by way of example, with reference to the accompanying drawings, in which:

FIGS. 1*a* to 1*d* show the build up of dots in a four-fill printing system;

In the examples described below, a "100% solids" ink is used. After the ink is jetted onto the substrate, it all becomes solidified by exposure to UV radiation. The ink comprises a monomer/oligomer mix with a UV initiator. When the ink is exposed to UV light, it initiates a polymerisation and crosslinking reaction which solidifies the liquid ink.

In the examples described below, a Sericol UviJet UV curable ink is used. After a pass of ink has been deposited, the ink on the substrate is partially cured using a UV lamp. The partial curing lamp is a Philips Special HID lamp HPR 125 W and the radiation dose from the from the partial curing lamp is not enough to completely cure the ink droplets on the substrate, but partially cures the droplet enough so that it does not interact with adjacent droplets on the substrate. The upper surface of the droplet, however, remains liquid or gels. Once all of the ink has been deposited on the surface, a UV lamp is used to complete the cure of the ink droplets.

The example described below uses a scanning inkjet printing system, for example the EAGLE H printer of Inca Digital Printers Limited. In this system any given area of the substrate is repeatedly passed over by printheads to build up the print image.

Figure 1D:
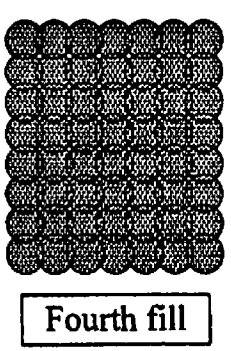
Figure 1C:
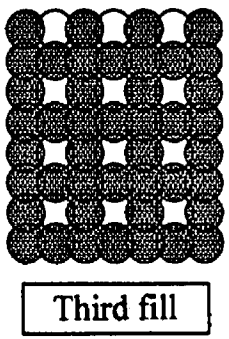
Figure 1B:
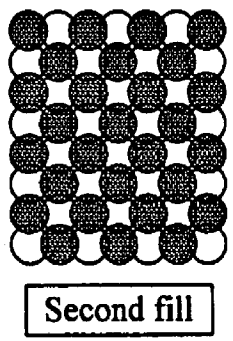
Figure 1A:
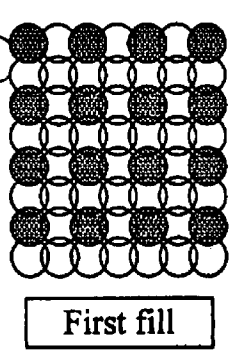

FIGS. 1*a* to 1*b* show a typical fill pattern of a single colour using four fill printing on the EAGLE H printer.

The figures show that the printed image comprises a generally square array of printed dots (represented by circles). Each fill shows a set of positions in which drops of ink can be printed by one printhead. The shaded circles 10 show drops which are printed in that particular fill: in one pass by one printhead. Open circles 12 show the position of drops to be printed in subsequent fills.

In the printer arrangement described herein, the four fills are carried out in two passes of the printhead arrangement over the substrate. In this example, the first and second fills are laid down in the first pass; the third and fourth in the second pass.

The drops are printed using a printhead having one or more rows of printing nozzles which emit droplets of ink. In this example, the distance between the nozzles of the row is twice the drops spacing for the printed image, and thus the printhead prints on every other drop. In the first pass, as shown in FIGS. 1*a* and 1*b*, square grids of drops are printed, each grid having a pitch which is twice the drop pitch for the completed printed image. In the second fill, shown in FIG. 1*b*, drops are printed diagonally between the drops printed in the first fill.

The second pass, shown in FIGS. 1*c* and 1*d*, fills in the remaining drops.

It might appear that the first and second fills of printing would not cause a problem of interaction between the drops because the drops do not touch or overlap as shown in FIG. 1*b*. However, in practice, there are errors in drop placement which mean that there will be overlaps, and therefore potential interactions between drops on the surface.

Figure 2:
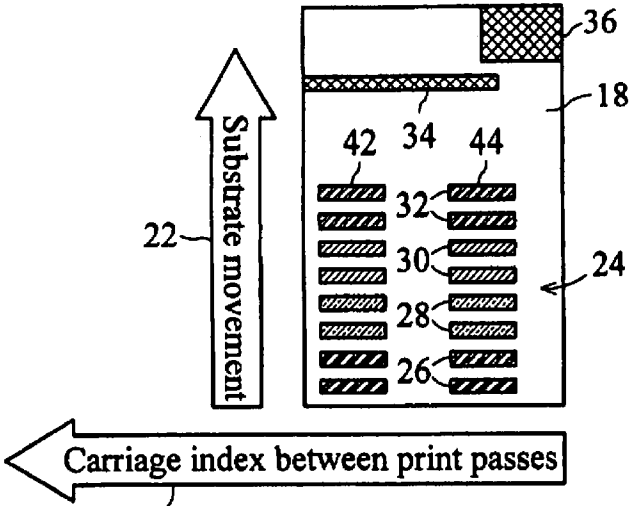
FIG. 2 illustrates the configuration of a printhead/printhead carriage used in an example.

FIG. 2 shows a top view of a printer carriage 18 arrangement. The printer carriage is mounted for lateral movement 20 relative to a substrate under the printhead (not shown). The substrate is mounted for movement 22 relative to the carriage. The movement of the substrate is substantially perpendicular to the lateral movement of the carriage 18.

In the carriage 18 are arranged sixteen printheads in two lines of eight. Each line of eight printheads includes two cyan 26, two magenta 28, two yellow 30 and two black 32 printheads.

The printheads used are Spectra Galaxy printheads. In another example, the printheads used are Spectra Nova 256 printheads.

The two lines of printheads are here laid out one "stripe width" apart, that is the distance between the lines is substantially equal to the active width of each printhead. It would also be possible to use other geometries.

The carriage also includes a "partial cure" lamp 34. An example of a suitable lamp is a Philips Special HID lamp HPR 125 W which gives radiation having a wavelength greater than 340 nm. The partial cure lamp 34 is arranged "behind" the printheads 24 so that the substrate moving under the carriage first passes under the printheads 24 and then under the partial cure lamp 34.

The carriage 18 further includes a "full cure" lamp 36. This curing lamp is a GEW NUVA mercury arc lamp. The curing lamp is arranged behind the partial cure lamp, and is also laterally displaced from the printheads 24 and the partial cure lamp 34 so that the curing lamp 36 only passes over an area of the substrate after the printing by the printheads 24 is complete.

Each print stroke takes the substrate under the printheads then the UV lamps. Between each print stroke the print carriage 18 moves to the left 20 by a certain amount, for example by indexing to the left a pre-determined distance depending on the print mode chosen. It can be seen that the first ink layers printed on the substrate only get exposed to the partial cure lamp 34, and that the printed substrate does not pass under the full curing lamp 36 until all the ink has been jetted for that particular area of the substrate.

Figure 3:
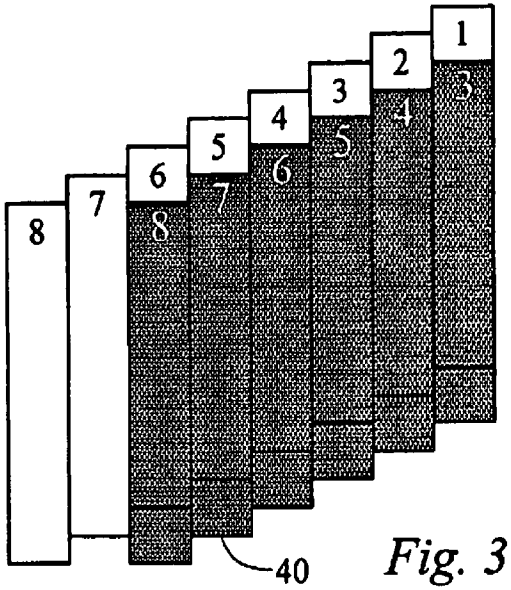
FIG. 3 illustrates the printing image.

FIG. 3 shows the build-up of the image. Each "stripe" 40 is numbered in order of the print pass when it was laid down, and for clarity each print pass is shifted down by a fixed amount (the higher up stripes being laid down first by the printheads in column 42). One possible "four fill" printing scheme is illustrated.

The arrangement builds up the printed image in two passes effecting four fills as shown in FIGS. 1*a* to *d*. The first pass (shown in FIGS. 1*a* and 1*b*) is printed using the printheads of the left hand column 42 of printheads 24. The first and second fills are printed by the two sets of cyan, magenta, yellow and black printheads which are arranged to give the desired printed image. The second pass over the area (FIGS. 1*c* and 1*d*) is printed using the sets of printheads in the right hand column 44 of printheads 24.

In the first print pass, only the left-hand column 42 of printheads 24 is used. On the second pass, the left hand column 42 again prints after the carriage 18 moves a "stripe" to the left. Then the carriage moves another stripe to the left and the third pass is printed by both columns 42, 44 of printheads 24. The fourth, fifth, sixth, seventh and eighth passes are then printed, each preceded by a carriage movement to the left of a print stripe.

The print carries on, but is shown as if interrupted after pass 8. This scheme of printing is used to achieve complete coverage of the area using the layout of printheads shown, but other arrangements could be used.

It will be seen that after each pass, the printed ink is set using the partial cure lamp 34. It will be seen that an area of the printed image is always completely laid down before being fully cured using the full curing lamp 36.

There is now described a method by which the surface finish of a printed substrate may be varied using a partial cure lamp.

Variations in surface finish on a printed substrate, for example, a gloss finish or a matt finish, can be achieved varying the level of the curing radiation received by the ink. As mentioned above, use of the partial cure lamp can improve wetting of the ink on the substrate from a previous pass by ink from a subsequent pass, whist maintaining the desired droplet placement on the substrate, thereby reducing undesireable surface effects including unjoined balls of ink and ridges of ink on the substrate.

One method of varying the level of curing radiation received by the ink is by using a combination of one or more partial cure lamps, and using a simple switching circuit which is arranged to switch on the desired number of partial cure lamps to achieve a desired surface finish effect.

An alternative method of varying the level of the curing radiation received by the ink is by varying the level of radiation emitted by a partial cure lamp, which can be achieved by varying the input power to the lamp as described below in FIG. 4.

Figure 4:
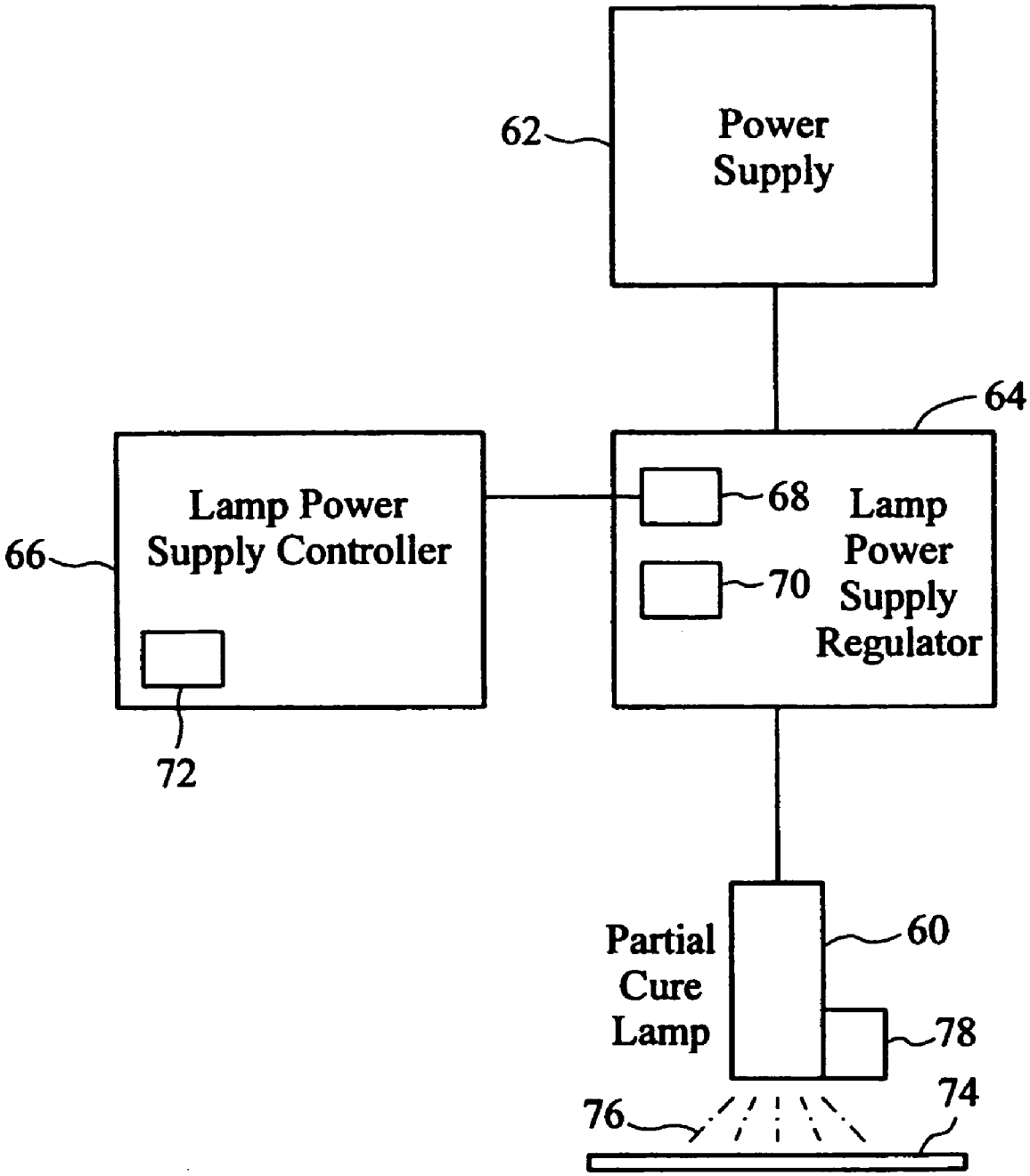
FIG. 4 illustrates a variable-power partial cure lamp.

FIG. 4 shows a schematic of an example of a partial cure lamp which is arranged to have its input power varied. A partial cure lamp 60 is fixed to a printhead 78. The lamp 60 emits curing radiation 76 onto a substrate 74 and is supplied with electrical power by a power supply 62 via a power supply regulator 64. The power supply regulator 64 is controlled by a controller 66 via a signal interface 68 or a manual control 70. The controller 66 is provided with an interface 72 which permits signals from an external device, such as a printer control circuit (not shown) to cause the controller 66 to regulate via the regulator 64 the input power to the lamp 60.

A fixed level of gloss of the printed ink on the substrate 74 can be achieved when printing at different velocities, for example when printing in different print modes in which the relative speed of the printheads to the substrate is different depending on the print mode selected for the current print.

A conventional inkjet printhead can move at varying velocities whilst printing, for example because of the nature of the image and other factors including the print mode and the type of substrate, which in the presently described embodiment can result in different regions of ink receiving different exposure times and levels of partial cure radiation. The relative speed of the motion of the printhead and partial cure lamp to the substrate, given a constant lamp power output, can determine the level of partial cure radiation received at the ink on the substrate. This variation in exposure at different regions of the substrate at the partial cure stage can lead to non-uniform surface finishes across the substrate.

It will be seen that a fixed level of gloss of the ink on an area of the substrate whilst printing at varying speeds can be achieved by varying the level of the partial cure by using a set up as described in FIG. 4.

The level of partial cure can be regulated by the controller 66 which can be used to regulate the power being supplied from the power supply regulator 62 to the partial cure lamp 60. Alternatively, a printing circuit in a printing system (not shown) can be used to interface with interface 72 or interface 68 to control the input power to the partial cure lamp based on, for example, the speed of the printhead whilst printing, or the image to be printed.

However, lower levels of power supplied to the partial cure lamp may result in shrinkage of the deposited ink at the full cure stage (for a free radical ink) which may cause an "orange peel" effect and may result in poor adhesion between successive layers of deposited ink.

In some situations it may be desired instead to vary the level of gloss of the printed ink, which can be achieved by varying the level of partial curing on a printed substrate independently of the rate of printing, for example by adjusting the power supply regulator by adjusting manual control 70 or by electronic signal received by signal interface 68.

Partial curing of UV curable inks can result in an partially cured ink which is stable wherein the image quality is not affected by small changes in the period between deposition of the ink and the full cure of the ink.

The following example describes a method in which the partial solidification of the ink before the final cure is carried out by heating the ink.

A similar printhead arrangement is used to that described above with reference to FIGS. 1 to 3. In this case, however, an ink is used which has a viscosity of above 50 centipoises at about 20 to 25 degrees C., and a viscosity of about 22 cp at 60 degrees C. The substrate to be printed is arranged on a printing bed. The substrate may have a surface temperature of about 20 to 25 degrees C. Such a bed may include a cooling system, for example if there are significant fluctuations in the temperature of the local environment.

The ink is heated to about 60 degrees C. and jetted onto the cool surface. The cool surface effects a local increase in the viscosity of an ink droplet landing on the surface and the increase in viscosity reduces the rate at which the ink droplets spread on the surface. This effects partial solidification of the droplet, thereby reducing ink spreading. The partial cure lamp might not be used in this example.

The following example describes a method wherein the full cure of the ink can be performed by using a full cure radiation source that is not proximate but rather is separate from the partial cure radiation source.

Figure 5:
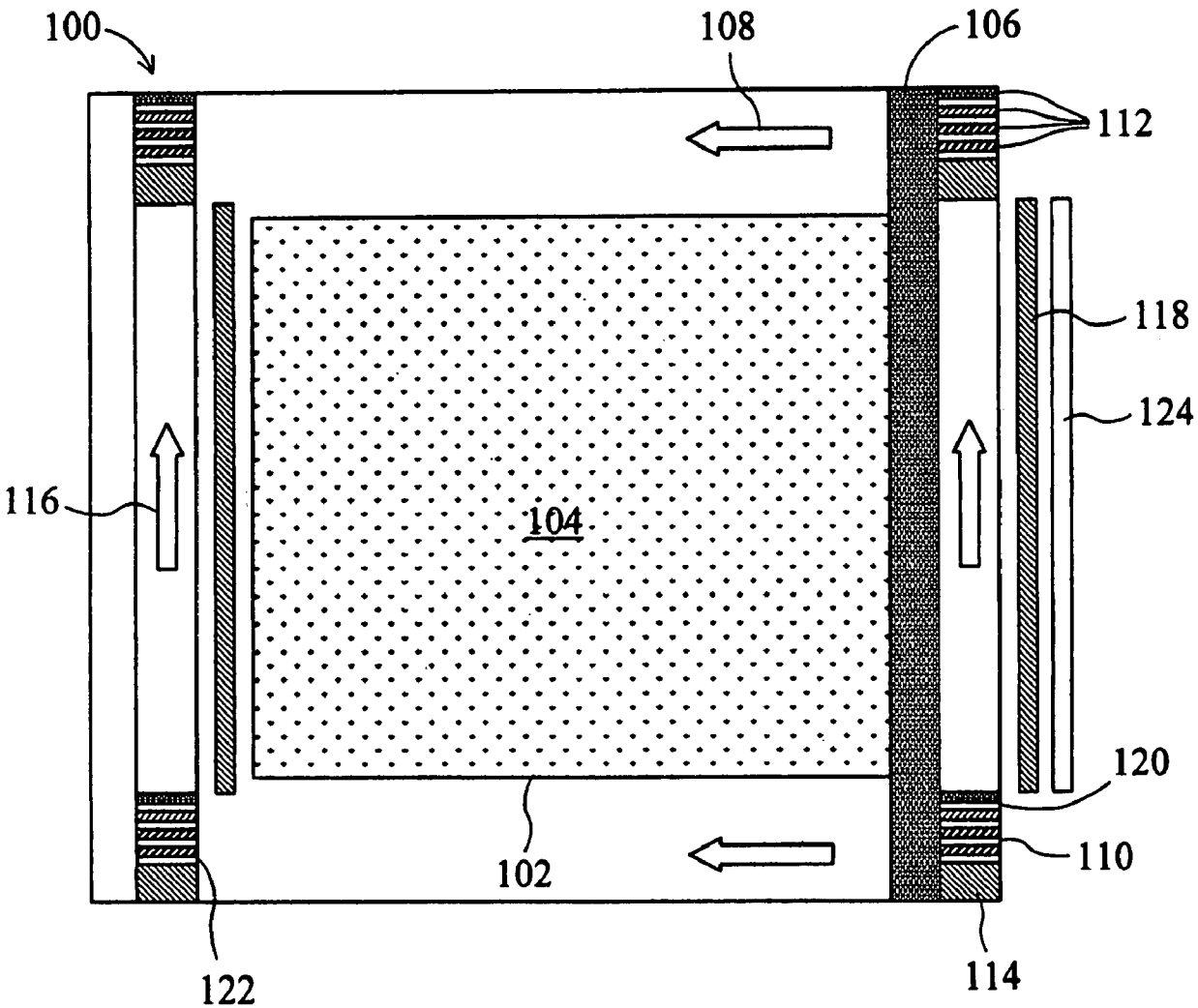
FIG. 5 illustrates the configuration of a printer wherein the full cure lamp is mounted off the printhead carriage.

FIG. 5 shows a top view of an inkjet printer 100. The components of the printer 100 shown include a substantially flat substrate table 102 for supporting the print substrate 104, above which X axis beam 106 is mounted for movement across the substrate in the Y-Axis direction 108. An inkjet printer carriage 110 comprising multiple printheads 112 and partial curing LED array 114 is mounted to the beam 106. Carriage 110 is arranged to move up and down in the X-Axis direction 116 along the beam 106. In another example, the partial curing radiation source comprises a UV lamp.

As shown in FIG. 5, the substrate 104 does not move and the movement of the beam 106 from right to left in the Y-Axis direction 108 is substantially perpendicular to the movement of the carriage 110 along the beam.

A full cure LED array 118 is provided mounted to the beam 106. The LED array 118 emits curing radiation with a wavelength in the region of 390 to 400 nm. In another example, the full cure radiation source comprises a UV lamp. The full cure LED array 118 has a length substantially equal to the full width of the substrate table 102 in the X-direction 116 and is mounted on the beam 106 such that it is above the substrate table 102 such that its length is disposed in the X-direction 166 parallel to and at pre-determined lateral distance from the X-Axis Beam 106.

The full cure LED array 118 is provided with an inerting system 124 which provides a nitrogen inerting gas at the substrate 104 at surface of the ink which is to be fully cured. In this example, the nitrogen gas is provided at the substrate only during the full cure step when the oxygen inhibition effect which inhibits curing of the ink is no longer required or desirable at the surface of the ink.

The nitrogen gas is supplied by a gas supply system (not shown) which separates nitrogen from atmospheric gas by use of a membrane system. These systems are well known in the art of gas separation. Alternatively, nitrogen gas could be supplied from a stored source such as a nitrogen bottle, but this is less desirable than producing nitrogen in situ. In another example, the inerting gas is carbon dioxide, which can be safer than nitrogen gas because the presence of an excess of nitrogen gas is generally undetectable by humans whereas the presence of an excess of carbon dioxide gas is detectable by humans as it can cause a choking reaction in humans.

The full cure LED array 118 moves laterally in the Y-Axis direction 108 from right to left across the substrate with the movement of the X-Axis beam 106. Alternatively, the full cure LED array 118 is mounted such that the beam 106 is capable of movement relative to the full cure LED array 118; for instance, the array may pass over the substrate on a separate transport mechanism.

The carriage 110 contains inkjet printheads 112 similar to the inkjet printheads 24 of FIG. 2 The partial cure LED array 114 is mounted behind the printheads 112 so that during printing as the carriage 110 moves the partial cure LED array 114 trails the printheads 112 as the carriage 110 and LED array 114 move over the substrate 104.

Printing starts with the carriage 110 in the start position 120 at the bottom right corner of the substrate table 102. The carriage 110 moves along the stationary X-Axis beam 106 in the X-Axis direction 116 thereby moving the printheads 112 and partial cure LED array 114 across the substrate 104 during which time ink is jetted from the inkjet printheads 112 on to the substrate, thereby effecting a print stroke across a particular area of substrate, each printhead forming a rectangular "stripe" of printed area parallel to the X-Axis beam 106. The width of the rectangular stripe of printed area is about the width of a printhead (not shown).

When all the ink to be deposited on the substrate during a particular print stroke has been jetted from the inkjet printheads 112, the X-Axis beam 106 indexes in the Y-Axis direction 108 a pre-determined amount, normally smaller than the width of the printheads 112, depending on the print mode selected. The carriage 110 then performs a second print stroke as described above, thereby covering the area of the substrate by further print strokes each preceded by the indexing to the left of the X-Axis beam 106. The printing continues until the arrangement of the X-Axis beam 106, carriage 110, partial cure LED array 114 and full cure LED array 118 are at the end position 122 at the bottom right corner of the substrate table 102.

During each print stroke the partial cure lamp may be switched on thereby exposing the deposited ink to the radiation provided by the partial cure lamp 114.

It will be seen that the arrangement of this example permits the final cure LED array 118 to be not proximate to or to be separate from the printer carriage 110. There are significant advantages to such an arrangement as the removal of a full cure radiation source such as a UV lamp from a printhead carriage, for example full cure lamp 36 as described in FIG. 2, can result in a significantly lighter carriage 110, thereby reducing the inertial effects on the carriage 110.

Figure 6:
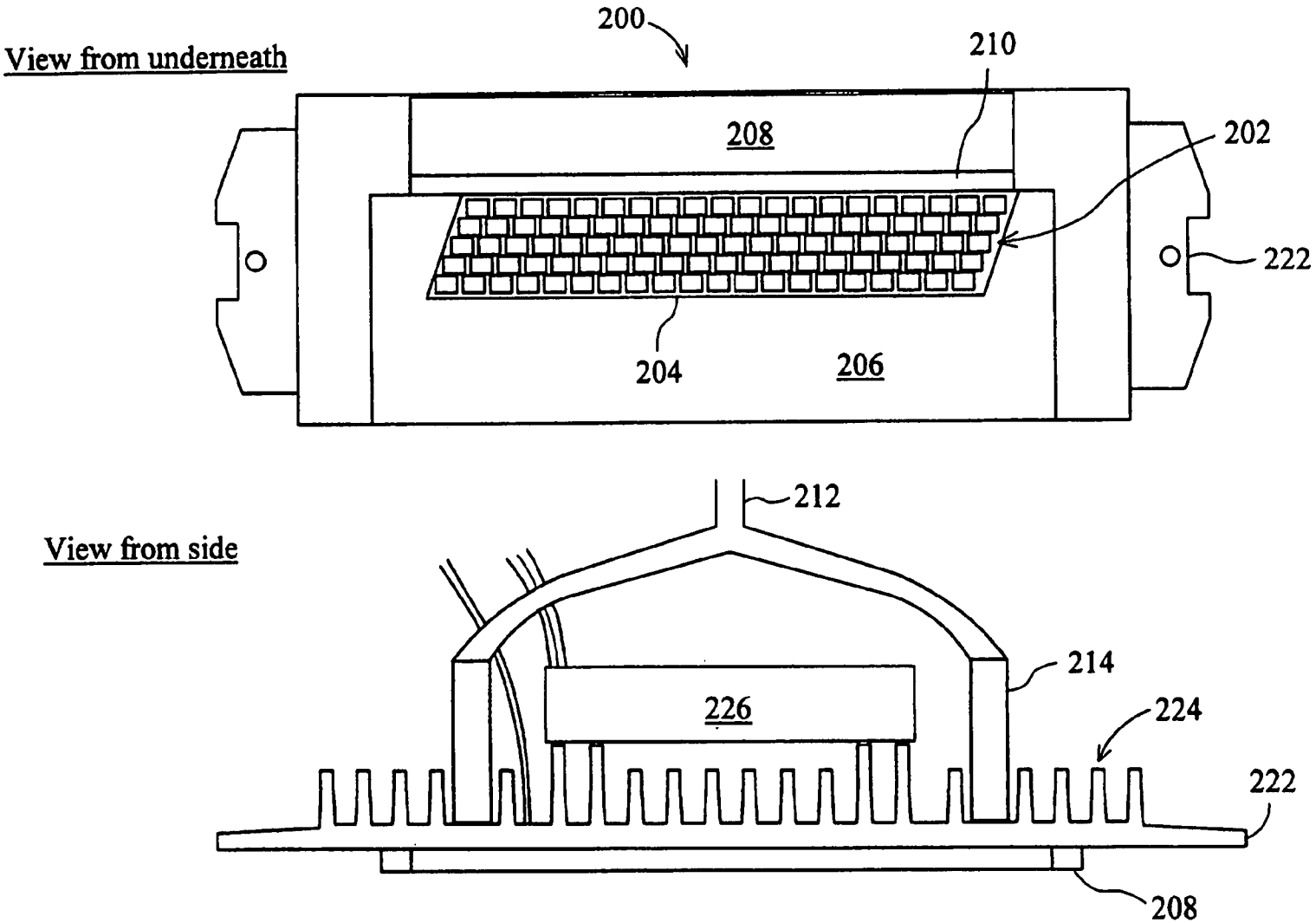
FIG. 6 illustrates an LED array which is used to provide curing radiation.

FIG. 6 shows an arrangement for using LED radiation sources for providing curing radiation which can be directed toward the deposited ink.

The arrangement 200 includes an LED array 202 set into a cavity 204 in a surround 206. The arrangement 200 further includes a gas purge cavity 208 arranged adjacent the LED array 202 and extending the full width of the array, the gas purge cavity 208 and the LED surround 206 are at approximately the same height above the substrate in use. In use, nitrogen gas is supplied through a nitrogen outlet 210 to the gas purge cavity from nitrogen tubes 212 and supply ports 214. The LED array is cooled by fan 226 mounted on cooling fins 224. The assembly is mounted to the printer or the print carraige via mounting bracket 222.

This arrangement 200 is suitable for use in the partial cure step and in the full cure step. In the partial curing step the LED array is mounted to the print carriage. In the full cure step the LED array is mounted separately from the carriage.

The LED array 202 emits partial curing radiation during the partial curing step.

During the partial curing step, the LED array emits curing radiation toward the ink. The nitrogen inerting gas is preferably not used during the partial curing step as this would reduce the use of the oxygen inhibition effect to provide a substantially liquid or gel form at the exposed surface of the ink.

In another example, for example with more powerful LED sources, nitrogen inerting gas may be used during the partial step to reduce the oxygen inhibiting effect.

During the full curing step, the inerting nitrogen gas is supplied to the deposited ink, displacing the oxygenated atmospheric air such that the radiation from the LED array 202 is received at the ink in the presence of the nitrogen gas.

It will be understood that the present invention has been described above purely by way of example, and modification of detail can be made within the scope of the invention.

Each feature disclosed in the description, and (where appropriate) the claims and drawings may be provided independently or in any appropriate combination.

The invention claimed is:

1. A method, for use with an inkjet device, of printing an area of a substrate in a plurality of passes using radiation curable ink, the method comprising a.) depositing with the inkjet device a plurality of spaced apart droplets of radiation curable ink onto the substrate in a first pass on the area;

b.) partially curing the ink deposited in the first pass such that an exposed surface of the partially cured ink is in non-solidified form, wherein the ink is partially cured with a first dose of radiation from a radiation source carried by the inkjet device;

c.) depositing with the inkjet device a second plurality of spaced apart droplets of radiation curable ink onto the substrate in a second pass on the area with the ink of the first pass being substantially wetted by the ink of the second pass;

wherein a.) and c.) are performed with the inkjet device in which discrete droplets of ink are deposited from at least one nozzle onto the substrate, the deposition of adjacent droplets of ink are separately controlled to permit mutually different adjacent droplets to be deposited on the substrate; and d.) fully curing the ink on the area with a further dose of radiation after all desired passes of ink have been deposited.

2. A method according to claim 1, wherein the partial curing step is such that an exposed surface of the partially cured ink is in substantially liquid or gel form.

3. A method according to claim 1, wherein the exposed surface of the partially cured ink is prevented from solidifying by oxygen inhibition.

4. A method according to claim 1, wherein the partial curing step effects at least partial curing of the ink adjacent the substrate.

5. A method according to claim 1, wherein the partial curing step effects at least partial curing of the ink such that the partially cured ink is stable after a period of minutes.

6. A method according to claim 1 wherein the ink comprises UV curable ink.

7. A method according to claim 6 wherein the wavelength of the radiation used in the partial curing step is greater than about 370 nm, preferably approximately between 380 nm and 420 nm, and more preferably approximately between 385 nm and 400 nm.

8. A method according to claim 1 wherein the fully curing step comprises providing an inerting or low oxygen environment.

9. A method according to claim 1 wherein the step of partially curing the ink is effected by a first device and the step of fully curing the ink is effected by a second device wherein the location of the first device is separate from the location of the second device.

10. A method according to claim 1, wherein the partially cured or partially solidified ink is such that at least a part of the ink can be displaced by rubbing.

11. A method according claim 1 further comprising emitting the ink using a printer carriage having one or more printheads;

at least partially curing the emitted ink using a first radiation source; and substantially fully curing the ink using a second radiation source, wherein the first radiation source for partially curing the ink is arranged to move with the one or more printheads, and the second radiation source for substantially fully curing the ink is arranged such that the one or more printheads can move relative to such radiation source.

12. A method according to claim 1 further comprising emitting radiation from a light emitting diode (LED) towards the ink.

13. A method according to claim 1, wherein the partial curing step includes a further step of varying the level of partial cure depending on the rate of printing.

14. A method according to claim 13, wherein the dose of curing radiation applied to a region of ink in the partial curing step is varied so as to vary the level of gloss of the printed ink on the area.

15. A method according to claim 1, wherein ink of the second pass is applied on top of ink of the first pass.

16. A method, for use with an inkjet device, of printing an area of a substrate in a plurality of passes using radiation curable ink, the method comprising:

depositing a first pass of ink on a first sub-area of the area by using radiation curable ink; and substantially immobilising the ink of the first pass on the area in a first partial-curing step so that a layer of ink adjacent the substrate has a viscosity greater than the viscosity of an exposed surface of the ink, wherein the ink is partially cured with a first dose of radiation from a source carried by the inkjet device, wherein the immobilised ink is such that it is substantially wettable by ink of a subsequent pass, and depositing a second pass of ink on a second sub-area adjacent to the first sub-area by using radiation-curable ink, wherein only a minor part of the second pass of ink is deposited on top of partially cured ink deposited on the substrate including the first pass of ink.

17. Apparatus for an inkjet device, for use in printing an area of a substrate in a plurality of passes using radiation curable ink, comprising:

a printhead arranged to deposit a first pass of ink using radiation curable ink on a first sub-area of the area;

a radiation source carried by the printhead for partially curing the ink deposited on the area wherein the radiation source for partially curing the ink is adapted to partially cure the ink such that an exposed surface of the partially cured ink is in non-solidified form and that a layer of the partially cured ink adjacent the substrate has a viscosity greater than the exposed surface of the partially cured ink; and a printhead arranged to deposit a second pass of ink on a second sub-area adjacent to the first sub-area, wherein only a minor part of the second pass of ink is deposited on top of partially cured ink deposited on the substrate including the first pass of ink; and means for substantially fully curing the ink on the area.

18. Apparatus according to claim 17, wherein the radiation source for partially curing the ink is adapted to partially cure the ink such that an exposed surface of the partially cured ink is in substantially liquid or gel form.

19. Apparatus according to claim 17 wherein the radiation source for partially curing the ink is adapted to at least partially cure the ink adjacent the substrate.

20. Apparatus according to claim 17 wherein the radiation source for partially curing the ink is separate from the means for fully curing the ink.

21. Apparatus according to claim 17 further comprising means for varying the radiation output of the radiation source so as to vary the level of gloss on the printed ink on the area.

22. An inkjet device, including an apparatus according to claim 17 for printing on an area of a substrate using ink, the device comprising a printer carriage having one or more printheads for depositing the first and second passes of ink; and a radiation source for substantially fully curing the ink, wherein the radiation source for partially curing the ink is arranged to move with the one or more printheads, and the radiation source for substantially fully curing the ink is arranged such that the one or more printheads can move relative to such radiation source.

23. An inkjet device according to claim 22 further comprising a beam movable with respect to the area of the substrate and a printer carriage adapted to move along the beam as well as with the beam, wherein the radiation source for fully curing the ink and the beam are adapted to be relatively moveable.

* * * * *